US007331816B2

(12) United States Patent
Krohn et al.

(10) Patent No.: US 7,331,816 B2
(45) Date of Patent: Feb. 19, 2008

(54) HIGH-SPEED DATA INTERFACE FOR CONNECTING NETWORK DEVICES

(75) Inventors: Sune G. Krohn, København N (DK); Thomas Kirkegaard Jørgensen, Søborg (DK); Jacob Michael Christensen, Virum (DK); Henrik Madsen, Frederiksberg (DK)

(73) Assignee: Vitesse Semiconductor Corporation, Camarillo, CA (US)

( * ) Notice: Subject to any disclaimer, the term of this patent is extended or adjusted under 35 U.S.C. 154(b) by 0 days.

(21) Appl. No.: 11/555,168

(22) Filed: Oct. 31, 2006

(65) Prior Publication Data

US 2007/0212927 A1 Sep. 13, 2007

Related U.S. Application Data

(60) Provisional application No. 60/780,628, filed on Mar. 9, 2006.

(51) Int. Cl.
*H01R 11/00* (2006.01)

(52) U.S. Cl. ..... 439/502

(58) Field of Classification Search ..... 439/502, 439/501, 507, 607, 540.1; 370/445, 450, 370/16, 217

See application file for complete search history.

(56) References Cited

U.S. PATENT DOCUMENTS

| | | | | |
|---|---|---|---|---|
| 5,577,023 | A * | 11/1996 | Marum et al. | 370/225 |
| 5,923,663 | A * | 7/1999 | Bontemps et al. | 370/445 |
| 6,385,208 | B1 * | 5/2002 | Findlater et al. | 370/419 |
| 6,661,805 | B1 * | 12/2003 | Romano et al. | 370/450 |
| 6,935,896 | B1 | 8/2005 | Tsai | |
| 7,227,869 | B2 * | 6/2007 | Findlater et al. | 370/419 |
| 2004/0127091 | A1 * | 7/2004 | Naito et al. | 439/488 |
| 2006/0239183 | A1 * | 10/2006 | Robitaille et al. | 370/217 |

* cited by examiner

*Primary Examiner*—Chandrika Prasad
(74) *Attorney, Agent, or Firm*—Christie, Parker & Hale, LLP

(57) ABSTRACT

An interface adapted for high speed data transmission between network elements that decreases signal interference and cross-talk between the wires of a cable used for connecting the network elements. Various connection schemes are used for shielded pairs of wires within a cable used for the interface. The connection schemes may use pins having same or different pin numbers at the two network elements being connected. Shielded pairs carrying data in a common direction may be connected to adjacent sets of pins or to non-adjacent sets of pins. Certain pins at each element may remain unused. Pairs of the shielded pairs within the cable may be cross-connected between the two elements. Shielded pairs may be cross-connected while leaving sets of pins unused.

25 Claims, 5 Drawing Sheets

500

| 511 Cable Connector Pins | 505 Signals | 501 Option 1 | 502 Option 2 | 503 Option 3 | 513 Cable Connector Pins |
|---|---|---|---|---|---|
| 1,3,2 | Shielded pair 1 | → | → | → | 1,3,2 |
| 4,6,5 | Shielded pair 2 | → | ← | ← | 4,6,5 |
| 7,9,8 | Shielded pair 3 | ← | ← | → | 7,9,8 |
| 10,12,11 | Shielded pair 4 | ← | → | ← | 10,12,11 |
| 13-19 | Additional signals | | | | 13-19 |

FIG. 5

600

| 611 Cable Connector Pins | 601 Enhanced Wire Diagram 1 | 602 Enhanced Wire Diagram 2 | 603 Enhanced Wire Diagram 3 | 604 Enhanced Wire Diagram 4 | 613 Cable Connect or Pins |
|---|---|---|---|---|---|
| 1,3,2 | Shielded pair 1 | Shielded pair 1 | Shielded pair 1 | Shielded pair 1 | 1,3,2 |
| 4,6,5 | Shielded pair 2 | - | Shielded pair 2 | Shielded pair 2 | 4,6,5 |
| 7,9,8 | - | Shielded pair 2 | - | - | 7,9,8 |
| 10,12,11 | Shielded pair 3 | - | Shielded pair 3 | - | 10,12,11 |
| 13,15,14 | Shielded pair 4 | Shielded pair 3 | - | Shielded pair 3 | 13,15,14 |
| 16,18,17 | - | Shielded pair 4 | Shielded pair 4 | Shielded pair 4 | 16,18,17 |
| 19 | - | - | - | - | 19 |

FIG. 6

700

| 711 Cable Connector Pins | 705 Signals | 713 Cable Connector Pins (Crossed 1) | 713' Cable Connector Pins (Crossed 2) | 713'' Cable Connector Pins (Crossed 3) |
|---|---|---|---|---|
| 1,3,2 | Shielded pair 1 | 7,9,8 | 4,6,5 | 10,12,11 |
| 4,6,5 | Shielded pair 2 | 10,12,11 | 1,3,2 | 7,9,8 |
| 7,9,8 | Shielded pair 3 | 1,3,2 | 10,12,11 | 4,6,5 |
| 10,12,11 | Shielded pair 4 | 4,6,5 | 7,9,8 | 1,3,2 |
| 13-19 | Additional signals | 13-19 | 13-19 | 13-19 |

FIG. 7

800

| 811 Cable Connector Pins | 801 Enhanced Wire Diagram 1 | 813 Cable Connector Pins (Crossed 1) |
|---|---|---|
| 1,3,2 | Shielded pair 1 | 10,12,11 |
| 4,6,5 | Shielded pair 2 | 13,15,14 |
| 7,9,8 | | |
| 10,12,11 | Shielded pair 3 | 1,3,2 |
| 13,15,14 | Shielded pair 4 | 4,6,5 |
| 16,18,17 | - | |
| 19 | - | - |

FIG. 8

HIGH-SPEED DATA INTERFACE FOR CONNECTING NETWORK DEVICES

CROSS-REFERENCE TO RELATED APPLICATION

This application claims the benefit of the filing date of U.S. Provisional Patent Application No. 60,780,628, filed Mar. 9, 2006, the disclosure of which is incorporated by reference herein.

BACKGROUND OF THE INVENTION

The present invention relates generally to network communications, and more particularly to connections between network devices.

Computational and data processing devices are commonly coupled so as to allow one device to communicate with another device. These devices may communicate using any number of protocols, with different protocols sometimes more widely used in various circumstances than others. For example, communications between different domains of very large networks such as the Internet may commonly occur using an Internet Protocol (IP), while proprietary domains and smaller networks may commonly use Ethernet Protocol or some variation of the Ethernet Protocol. In many networks, devices often do not communicate directly with one another and instead route data through switches. The switches are themselves network devices which appropriately forward information as required. In many instances, devices that are connected to one of a number of switches approximate a common location, with each of the switches coupled together either directly or, more commonly, in a daisy-chained manner or any ring topology.

Preferably, couplings used between the devices allow for high speed communication of data between the devices. These couplings often include a cable including one or more often shielded wires, that are further wrapped in a protective sheath. Ends of the cable often terminate at a connector, with the wires of the cable coupled to conductive mating elements, such as conductive pins or conductive sockets, of the connector.

For high speed data communication, several issues may arise with respect to particular cables and connectors. For example, assuming all other factors being equal, a coupling having multiple wires carrying information has increased effective data bandwidth as compared to a coupling having only a single wire carrying information. Unfortunately, having multiple wires carrying information increases the likelihood of signals on one wire interfering with signals on another wire. In addition, signal interference, or cross-talk, may also arise due to configuration of the conductive mating elements of the connectors. Such cross-talk may be reduced by increasing the distance between the wires or shielding of the wires in the cable. Cross-talk may also be reduced by providing increased spacing or shielding between conductive mating elements of the connectors. Increased spacing or shielding in cables and/or conductive mating elements, however, often leads to increased cost of the coupling, as well as increased connector footprint on the coupled devices.

An additional method of decreasing cross-talk involves providing a substrate at the connector for routing of signals from the wires to the conductive mating elements of the connectors. Unfortunately, use of such substrates tends to increase the cost of the couplings.

BRIEF SUMMARY OF THE INVENTION

The present invention provides an interface suitable for high speed data communication between devices. In one aspect, the invention provides a bidirectional coupling used between a pair of network devices, that comprises a plurality of shielded pairs of wires, the wires each having distal portions connected to a corresponding conductive mating element of a connector. The conductive mating elements may be selected from a plurality of conductive mating elements arranged in substantially parallel rows. Each shielded pair of wires provides a data path between a first network device and a second network device, and at least two of the shielded pairs provide data paths in opposing directions.

In another aspect, the invention provides a bidirectional data path between network devices comprising a first connector with a plurality of conductive mating elements arranged in two rows, a second connector with a plurality of corresponding conductive mating elements arranged in two rows, and a plurality of shielded pairs of wires connecting the first connector and the second connector. Each wire of the shielded pairs of wires connects non-corresponding conductive mating elements of the first connector and the second connector.

In another aspect, the invention provides a coupling for a pair of Ethernet switches in data communication with one another over the coupling. The coupling includes a wire coupling conductive mating elements associated with each of the Ethernet switches of the pair. A first of the Ethernet switches of the pair providing a signal on the wire indicating a status and a second of the Ethernet switches of the pair monitoring the signal on the wire.

BRIEF DESCRIPTION OF THE DRAWINGS

FIG. 5 provides a table showing pin connections for various communication options in accordance with first exemplary aspects of the invention;

FIG. 6 provides a table showing pin connections for various communication options in accordance with second exemplary aspects of the invention;

FIG. 7 provides a table showing pin connections for various communication options in accordance with third exemplary aspects of the invention; and FIG. 8 provides a table showing pin connections for various communication options in accordance with fourth exemplary aspects of the invention.

DETAILED DESCRIPTION

Figure 1:
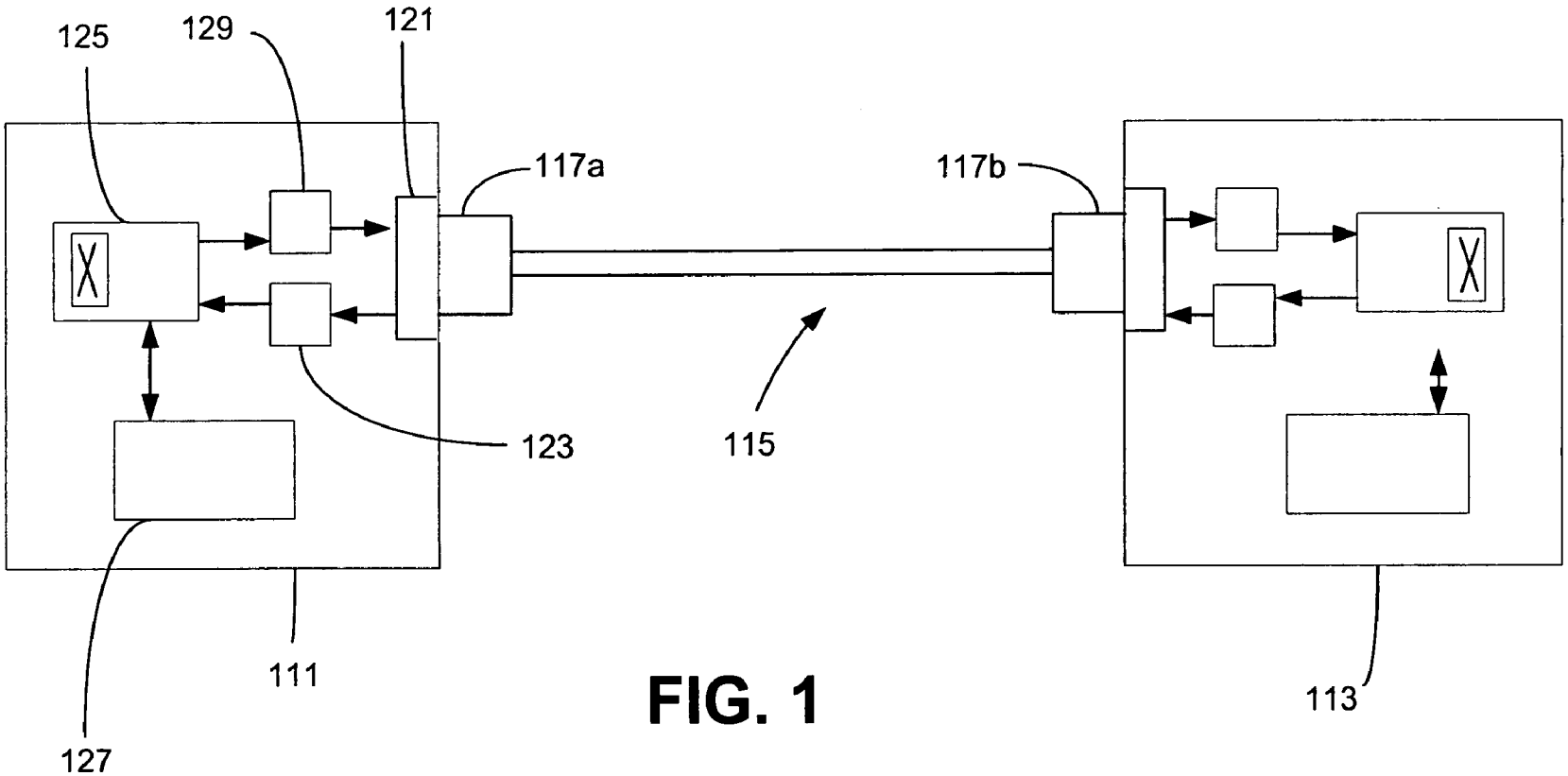
FIG. 1 is a block diagram of a pair of network devices coupled for bidirectional data communication in accordance with aspects of the invention.

FIG. 1 is a block diagram of a communication system in accordance with exemplary aspects of the invention. In FIG. 1 a first network device 111 is configured for bidirectional communication with a second network device 113. In many embodiments, each network device is a network communication switch, preferably an Ethernet switch. In practice, the first network device will usually be also connected to a number of other devices. In many instances, the network device includes a device connector 121 for mating with an external connector, an input processing block 123, a switch engine 125, that may include one or more cross-switches, a controller 127, and an output processing block 129. The input and output processing blocks 123, 127 may perform data recovery and serialization or deserialization functions, signal equalization, queuing, and other functions. In many instances the network devices, for example 111, 113, are in an approximately common location. Accordingly, the network devices are physically separated by less than one meter in many embodiments, physically separated by less than five meters in yet more embodiments, and physically separated by less than fifteen meters in most embodiments.

A coupling 115 connects the first network device and the second network device. The coupling includes a cable 117 with a cable connector 117*a*, 117*b* at each end of the cable 117. Each cable connector 117*a*, 117*b* is connected to the device connector 121 of the corresponding network device 111, 113. The connection provided by each cable connector 117*a*, 117*b* allows signal transmission from each corresponding network device 111, 113 to the cable 117.

Figure 1A:
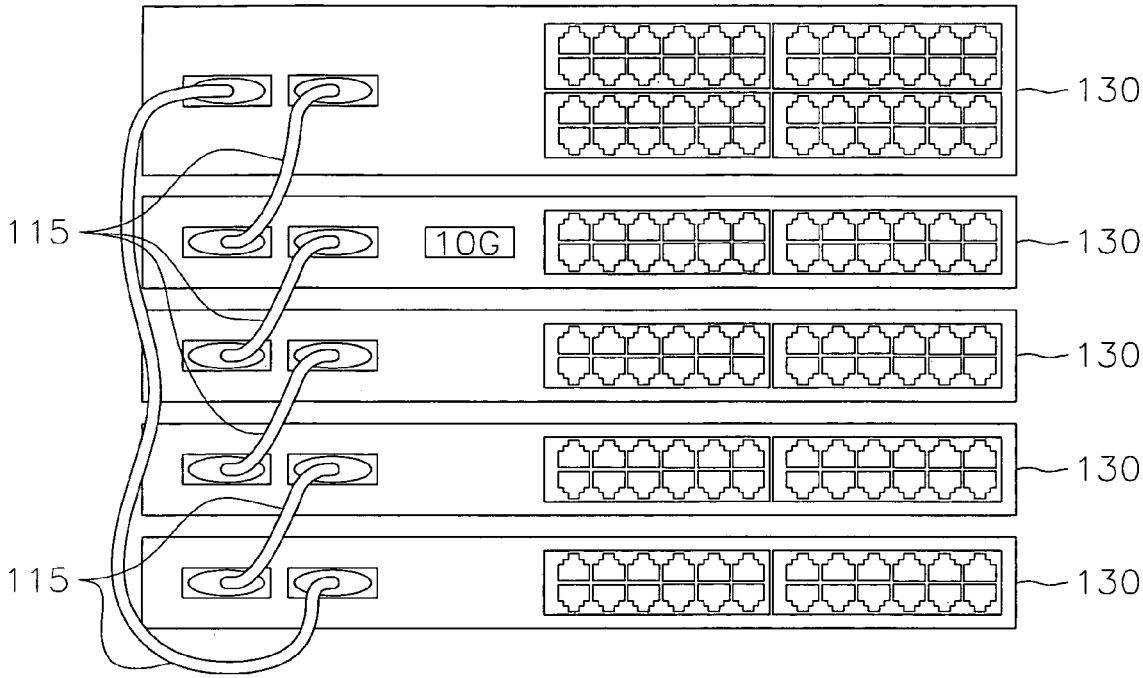
FIG. 1A shows a number of network devices coupled together.

As may be seen in FIG. 1A, a plurality of network devices 130 may be arranged with each network device 130 in connection with at least two other network devices 130. In addition, generally a number of other types of devices are also coupled to each network device 130. The network devices 130 may be coupled together with the cable 117.

Figure 2:
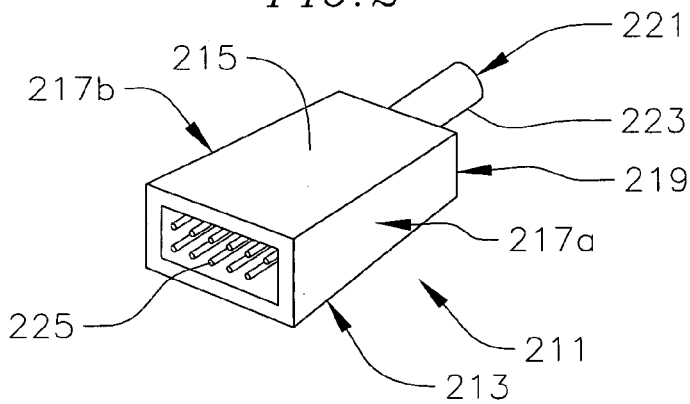
FIG. 2 illustrates a connector in accordance with aspects of the invention.

FIG. 2 illustrates an exemplary cable connector 200 in accordance with aspects of the invention. The exemplary connector 200 may correspond to the cable connectors 117*a* or 117*b* of FIG. 1. The connector 200 includes a housing 211. The housing includes a floor 213 and a ceiling 215 coupled at opposing side margins by walls 217*a*, 217*b*. A rear of the housing includes a wall 219 with an aperture 221 therethrough. The aperture is bounded by a cylindrical guide 223 and is configured to receive a cable, for example cable 117 of FIG. 1. The cable is preferably circular in cross-section.

Conductive pins 225 are disposed substantially within the housing 211, with some embodiments having the conductive pins 225 entirely within the housing 211. Rear portions of the pins are electrically coupled to corresponding wires of the cable. Generally the pins 225 are coupled to the wires in such a manner that the pins 225 may be considered directly connected to the wires. For example, in some embodiments the pins and wires are directly in contact with another. In other examples, the pins and wires are separated by solder or other metallic elements, but with the distance between the pins and wires being very slight, for example, less than five millimeters and preferably less than two millimeters.

Figure 3:
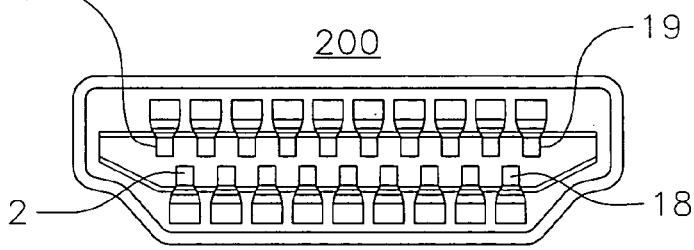
FIG. 3 illustrates a pin diagram for a connector in accordance with aspects of the invention.

Forward ends of the pins 225 may be arranged in two rows. FIG. 3 shows an exemplary pin configuration for pins arranged in two rows. Preferably, a first row includes more pins than a second row, and the pins in each row are offset from pins in the other row. Also, preferably forward ends of the pins may be configured for sandwiching a plate or substrate, for example, of the device connector 121 of the network device 111, with the plate including conductive elements on a top and a bottom of the plate. In the example of FIG. 3, a first row includes ten pins and a second row includes nine pins. For convenience the pins of the first row are identified by odd numbers, starting with pin 1 furthermost to the left (as viewed in FIG. 3), increasing pin number from left to right, and ending with pin 19 furthermost to the right. Similarly, the pins of the second row are identified by even numbers, with pin 2 furthermost to the left, pin 18 furthermost to the right, and increasing pin number from left to right. In various embodiments, a forward edge of pin 18 is recessed as compared to forward edges of the other pins. In some embodiments, the pins are preferably configured as specified for a Type A receptacle (cable connector) in the High-Definition Multimedia Interface Specification Version 1.2, available from the HDMI Licensing, LLC, incorporated by reference herein.

In other embodiments, the number and arrangement of pins are as specified for a Type B receptacle (cable connector) described in the same specification. The Type B receptacle (not shown) has 29 pins that are arranged in two parallel rows. Type A and Type B receptacles correspond to the cable connectors 117*a*, 117*b* of FIG. 1. The top row includes odd-numbered pins having consecutive odd pin numbers 1 through 29 and the second row includes even-numbered pins having consecutive even pin numbers 2 through 28. In both Type A and Type B cable connectors, the odd-numbered and the even-numbered pins are located in a staggered manner such that each even-numbered pin falls approximately between two consecutively numbered odd-numbered pins. The two rows of pins are separated by a narrow space in between and the pins of one row do not engage or touch the pins of the other row. Otherwise, the pins of the two facing rows resemble teeth of two combs facing each other.

Figure 4:
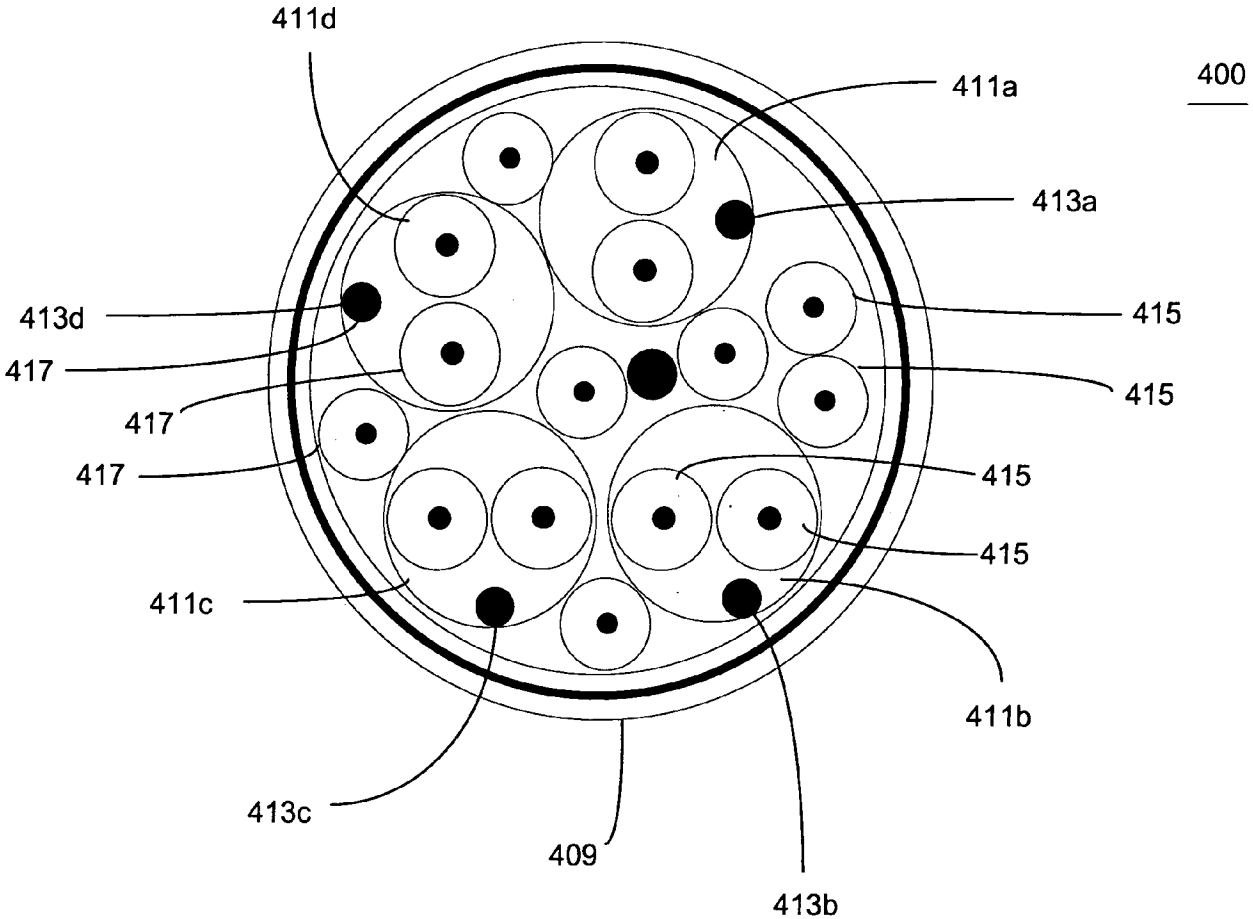
FIG. 4 illustrates a cross section of a cable in accordance with aspects of the invention.

FIG. 4 shows a cross section of a cable 400 in accordance with aspects of the invention. The cable 400 may correspond to the cable 117 of FIG. 1. The cable of FIG. 4 is exemplary and, in various embodiments, other cable configurations and/or layouts may be used. The cable 400 of FIG. 4 includes an outer sheath 409 around four shielded differential pairs 411*a*, 411*b*, 411*c*, 411*d* and a number of other wires. The shielded differential pairs are also referred to as shielded pairs 411*a-d*. Other embodiments may include seven or eight differential pairs and various number of wires which may or may not be provided as shielded pairs. Each of the four shielded pairs 411*a-d* includes an associated shield wire 413*a*, 413*b*, 413*c*, 413*d* or 413*a-d*. The shield wire allows for placement of a signal, for example a set voltage such as ground, on the shield wire 413*a-d* for each differential pair of each shielded pair 411*a-d*. In most embodiments each wire of a differential pair is twisted about the other wire of the differential pair through the length of the cable 400. In addition, in some embodiments, although not generally, the differential pairs are also twisted about the other differential pairs throughout the length of the cable. As illustrated, the cable 400 also includes further differential pairs 415 and single wires 417. In various embodiments, differing numbers of differential pairs 415 or wires 417 are provided. Some embodiments don't include any extra pairs or wires. Each of the wires 417, including the wires of the shielded differential pairs 411*a-d*, are insulated throughout the length of the cable 400.

In the exemplary embodiments shown, a total of nineteen wires 417 are included in the cable 400. The nineteen wires include the shield wires 413*a-d* and the two wires included in each differential pair 415 or each shielded differential pair 411*a-d*. The nineteen wires 417 of cable 400 correspond to the nineteen conductive pins 225 of the cable connector 200 of FIG. 2.

In some embodiments, a cable with cable connectors at ends of the cable is used to couple two network devices. Preferably the cable connectors are similar to the cable connector 200 discussed with respect to FIG. 3, and the cable may be similar to the cable 400 discussed with respect to FIG. 4. The network devices may be Ethernet switches. Preferably, information being provided from a first Ethernet switch to a second Ethernet switch, is inverse multiplexed onto two, or more than two in various embodiments (for example four) shielded differential pairs of the cable. Similarly, data provided from the second Ethernet switch to the first Ethernet switch is inverse multiplexed onto two shielded differential pairs of the cable that are different from the two shielded differential pairs used to provide data from the first to the second Ethernet switch. The inverse multiplexing is generally performed by the switch, for example by a block associated with an input or output processing block (123, 129 of FIG. 1) and/or a block performing framing or queuing function. Inverse multiplexing allows a data stream to be broken into multiple lower data rate communications links. Inverse multiplexing is the opposite of multiplexing which creates one high speed link from multiple low speed ones. In some embodiments the information is inverse multiplexed on a bit-wise basis, in other embodiments the information is inverse multiplexed on a byte-wise basis, and in other embodiments other inverse multiplexing schemes are used. For example, preferably inverse multiplexing is accomplished on a frame-by-frame basis. In addition, various interleaving schemes may also be used.

For ease of description, and without loss of generality, the exemplary embodiments shown in FIGS. 1, 2, 3, and 4 are used to describe the operation indicated by the tables of FIGS. 5, 6, 7, and 8. The cable 400 of FIG. 4 is used to connect the first network device 111 and the second network device 113 of FIG. 1.

FIG. 5 provides a table 500 indicating pin assignments for cable connectors such as the cable connector 200 of FIG. 3 for shielded pairs of a cable, such as the shielded pairs 411*a-d* of the cable 400 of FIG. 4. The table of FIG. 5 indicates connector pins corresponding to each of the shielded pairs and direction of data travel between network devices for several options. Generally the last pin number referenced denotes a shield wire pin. In various embodiments, however, any one of the pins for a differential pair are used for the shield wire pin.

Each of the shielded pairs are coupled to pins having the same pin numbers at both ends. Four sets of adjacent pins are used at each end. There are three pins within each set. The pins within each set are adjacent one another and the sets are also adjacent. Generally, the last few pins of each row are used for additional signals or are unused. In the various options, different combinations of the shielded pairs are used to direct data in either of the two directions between the network devices. In one option, two of the shielded pairs coupled to two adjacent sets of pins carry data in the same direction and another two of the shielded pairs coupled to another two adjacent sets of pins carry data in the reverse direction. In other options, the two shielded pairs that are coupled to adjacent sets of pins carry data in opposite directions. It is believed that Option 1 of the table 500, utilizing shielded pairs coupled to adjacent sets of pins for data travel in the same direction, provides preferred performance with respect to signal degradation, particularly due to cross-talk.

Three columns 501, 502, 503 of the table 500 set forth respectively first, second, and third options for establishing the connection. Column 505 shows the shielded pairs 411*a-d* used for the connection. Column 511 shows the correspondence between the pins 225 of the cable connector 200 used to connect the cable 400 to the first network device 111 and the wires 417 of the cable 400. Column 513 shows the correspondence between the pins 225 and the wires 417 at the connection to the second network device 113. As shown in FIG. 4, each of the first to fourth shielded pairs (shielded pair 1 to shielded pair 4) in FIG. 5 includes two wires in the differential pair 415 and the third shield wire 413*a-d* for a total of three wires. The two wires in each differential pair are coupled between the first two pins listed in columns 511 and 513. The shield wire of each shielded differential pair is coupled to the third pin listed in the columns 511 and 513. As table 500 indicates, each of the first to fourth shielded pairs 411*a-d* is connected to the same pins at both ends of the cable 400. In other words, the three wires in the shielded pair 1 are coupled to pins 1, 3, and 2 at the cable connector at the first network device 111 and to pins having the same pin numbers 1, 3, and 2 at the cable connector at the second network device 113. In the first option 501, the first and second shielded pairs 411*a,b* are used to transmit from the first network device 111 to the second network device 113 and the third and fourth shielded pairs 411*c,d* are used to transmit from the second 113 to the first 111 network device. In the other options 502, 503, the shielded pairs used for transmitting and receiving in each direction are differently assigned. According to the pin assignment for the first option 501, the adjacent pins 1 and 3 and the adjacent pins 4 and 6 of the cable connector 200 are all used for transmitting from the first 111 to the second 113 network device. The pin 2 which would be between and below pins 1 and 3 in the embodiment of FIG. 3 and pin 5 which would be between and above pins 1 and 6 in the same embodiment are used to shield the pins carrying the signals. In the first option 501, the pins 1, 2, and 3 for shielded pair 1 and the pins 5, 4, and 6 for shielded pair 2, are all used for transmitting from the first 111 to the second 113 device and the pins 7, 8, 9, 10, 11, and 12 are used for receiving at the first network device 111, a signal transmitted by the second network device 113. The remaining pins 13-19 may be used for additional signals.

FIG. 6 provides a table 600 indicating a second exemplary set of pin assignments for shielded pairs of wires. Each of the shielded pairs are coupled to pins having the same pin numbers at both ends. Four sets of adjacent pins are used at each end. There are three pins within each set. The pins within each set are adjacent one another. However, the sets of adjacent pins, that are coupled to the shielded pairs, may or may not be adjacent. Some sets of pins of each row remain unused. In the various options that are called Enhanced Wire Diagrams, two adjacent sets may be used for two shielded pairs and another two adjacent sets may be used for another two shielded pairs. There may be one or more unused sets between the two pairs of sets that are coupled to the cable. In other options, two adjacent sets may be used for two of the various options and another two nonadjacent sets may be used for the remaining two shielded pairs.

Using the nomenclature of FIG. 6, it is believed that Enhanced Wire Diagram 1 provides preferred performance with respect to signal degradation. The Enhanced Wire Diagram 1 uses two pairs of adjacent sets. One set is left unused between the two pairs. In many embodiments the pin denoted as pin 18 has a recessed forward end as compared to the other pins and the Enhanced Wire Diagram 1 does not utilize pin 18. Pin 18 may be coupled to a power supply.

Four different permutations for connecting the four shielded pairs 411*a-d* of FIG. 4 to the nineteen pins 225 of FIG. 3 are shown in the four options shown in table columns 601, 602, 603, and 604. The first and last columns 611, 613 indicate the pin numbers used at the cable connector 200 at each end of the cable 400. For example, the wires of the shielded pair 1 are connected to pins 1, 3, and 2 at both ends in all four options or all four Enhanced Wire Diagrams 601, 602, 603, 604. As another example, the wires of shielded pair 2 are connected to pins 4, 6, and 5 at both ends in the first, third, and fourth Enhanced Wire Diagrams 601, 603, 604 and between pins 7, 9, and 8 at both ends in the second Enhanced Wire Diagram 602. In all of the four options 601, 602, 603, 604 shown in table 600 of FIG. 6, the three wires of each shielded pair 1-4 are always coupled between two sets of pins having the same pin numbers.

In the first Enhanced Wire Diagram 601, three pins 7, 8, 9 are left unused, thus separating the pins connected to the shielded pair 1 and shielded pair 2 from the pins connected to shielded pair 3 and shielded pair 4. In other Enhanced Wire Diagrams 602, 603, 604, other of the pins are left unused to introduce a space between the pins connected to shielded pairs.

In some instances, improved signal quality may potentially be achieved through use of different pin assignments for shielded pairs at cable connectors at opposing ends of the cable. FIG. 7 provides a table 700 indicating pin assignments for several such embodiments.

When different pin assignments are used at each end, the shielded pairs cross and the options thus created are called Crossed. For each Crossed option, a first and a second shielded pair are crossed. If the first shielded pair is coupled to a set of pins having a first group of pin numbers at the first network device and to a set of pins having a second group of pin numbers at the second network device, then, the second shielded pair would be connected to pins having the second group of pin numbers at the first network device and to pins having the first group of pin numbers at the second network device.

The first column 711 of table 700 shows the pin assignments for each shielded pair 705 at the cable connector 117*a* of the first network device 111 and the three options shown in columns 713, 713', and 713" show the pin assignments for each shielded pair at the cable connector 117*b* of the second network device 113. All of the options shown 713, 713', 713" indicate crossed wires because the wires of the each shielded pair 411*a-d* are connected to pins having different pin numbers at the two ends. For example, in the Crossed 1 option 713, the wires of the first shielded pair 411*a* are connected between pins 1, 3, and 2 at one end and pins 7, 9, and 8 at the other end; the wires of the second shielded pair 411*b* are connected between pins 4, 6, and 5 at one end and pins 10, 12, and 11 at the other end; the wires of the third shielded pair 411*c* are connected between pins 7, 9, and 8 at one end and pins 1, 3, and 2 at the other end; and finally, the wires of the fourth shielded pair 411*d* are connected between pins 10, 12, and 11 at one end and pins 4, 6, and 5 at the other end.

Differing wiring is used at the two ends of the cable 117 to obtain crossing of the shielded differential pairs that carry the data. Symmetrical crossing of the four shielded pairs 411*a-d* can be done in three ways that are shown in table 700. In the Crossed 1 option 713, the first and third shielded pairs are cross-connected and the second and fourth shielded pairs are cross-connected. In the Crossed 2 option 713', the first and second shielded pairs are cross-connected and the third and fourth shielded pairs are cross-connected. In the Crossed 3 option 713", the first and fourth shielded pairs are cross-connected and the second and third shielded pairs are cross-connected.

Using the nomenclature of FIG. 7, it is believed the pin assignment indicted for Crossed 1 provides preferred performance with respect to signal degradation. In such embodiments, the switches coupled together may perform a handshaking routine to determine direction of data transmission over each shielded pair. In some embodiments this is accomplished using the shielded pairs themselves, but other embodiments utilize wires other than the shielded pairs for this purpose.

In other embodiments, however, each switch will transmit over shielded pairs coupled to predefined pins, such as pins 1,3 and 4,6 and receive over shielded pairs coupled to predefined pins, such as pins 7,9 and 10,12.

In some embodiments, pin assignments are generated through a combination of the pin assignments of FIG. 6 and FIG. 7. As an example, one such combination is shown in table 800 of FIG. 8. Other combinations are of course possible in view of FIG. 6 and FIG. 7, and understood completely by a person of skill in the art. As an example, pins 1,3 and 4,6 may be designated for transmission and pins 10,12 and 13,15 may be designated for reception. If the four different enhanced wire diagrams of table 600 and the three different crossing patterns of the table 700 are combined, a total of twelve ways of implementing an enhanced crossed wire diagram result. One exemplary embodiment of the twelve options is shown in FIG. 8.

In table 800, the first column 811 and the second column 801 correspond to the first and second columns 611, 601 of table 600. The first column 811 sets forth the pin connections at the cable connector 117*a* of the first network device 111 for the three wires in each of the first to fourth shielded pairs 411*a-d*. The third column 813 corresponds to the pin connections at the cable connector 117*b* of the second network device 113 for the wires in each of the shielded pairs 411*a-d*. Wires of each of the first to fourth shielded pairs are crossed between the two ends of the cable according to the Crossed 1 option of table 700 of FIG. 7. In the Crossed 1 option 713 of table 700, the ends of shielded pair 1 and shielded pair 3 are crossed and the ends of shielded pair 2 and shielded pair 4 are crossed. In other words, if shielded pair 1 is connected to pins 1, 3, 2 at the first 111 and to pins 7, 9, 8 at the second 113 network devices, then shielded pair 3 is connected to pins 7, 9, 8 at the first 111 and to pins 1, 3, 2 at the second 113 network devices. Similarly, the first end of shielded pair 2 is connected to pins having the same numbers as the pins connecting to the second end of shielded pair 4 and the second and first ends of the shielded pairs 2 and 4, respectively, are connected to pins having the same numbers at the two opposite sides of the cable 400. Applying this rule of crossing to the shielded pairs 801 and the pins 811 of table 800 yields the pins 813 at the other end of each shielded pair. For example, in table 800, the shielded pair 1 is connected to pins 1, 3, 2 at the first end and shielded pair 3 is connected to pins 10, 12, 11 at the first end. At the second ends of these two shielded pairs 1, 3 shown in column 813, the pin numbers are switched such that the second end of shielded pair 1 is connected to pins having the same numbers 10, 12, 11 as the pins 10, 12, 11 connected to the first end of shielded pair 3.

When using the exemplary wire diagram shown in table 800, the shielded pairs connected to pins 10, 12, 11 and 13, 15, 14 may be used for reception at the first network device 111 and the shielded pairs connected to pins 1, 3, 2 and 4, 6, 5 may be used for transmission of data from the first network device 111.

The directions of data travel and the pin connections shown in FIGS. 5, 6, 7, and 8 that apply to a 19-pin Type A cable connector may be similarly extended to a 29-pin Type B cable connector. The Type B cable connector may use eight shielded pairs instead of four where four of the pairs are used to transmit data from each network device and the other four are used to receive data at that network device.

In some embodiments, each network device 111, 113 (Ethernet switch) is cable of detecting whether the cable 117 is connected to the device. A specific pin may be used by each Ethernet switch to provide a signal, such as a positive voltage, that is used to indicate that a cable is connected to the Ethernet switch. The specific pin (a first pin) being monitored, is coupled to a wire coupling it to a different pin (a second pin) on the opposing connector. Thus, each Ethernet switch (for example a second switch) may monitor the second pin to determine if the other end (first end) of the connector is coupled to an Ethernet switch (for example the first switch) and thereby determine if the other end (first end) of the cable is connected to an Ethernet switch (the first switch). For example, pin 19 may be used for cable detection. Then, with enhanced or crossed wire diagrams, for example those shown in table 600 and 700, pin 19 at one end is not connected to pin 19 at the other end. Instead, pin 19 at one end is connected via a wire of the cable, to a pin other than pin 19 at the other end. This connection scheme allows the network device at each end to use its pin 19 for signal detection.

In various embodiments, the shielded differential pair may be used to transmit 8b/10b encoded Ethernet signals or 64b/66b encoded Ethernet signals. In 8b/10b encoding, 8 bits of data are transmitted as a 10-bit entity called a symbol, or character. The low 5 bits of data are encoded into a 6-bit group and the top 3 bits are encoded into a 4-bit group. These code groups are concatenated together to form the 10-bit symbol that is transmitted on the wire. The 64b/66b encoding, while similarly created, involves different design considerations.

Various embodiments of the invention decrease signal interference and cross-talk between the wires of a cable used for connecting network devices, without using increased additional insulating and shielding materials and without using a substrate at the connector for connecting the cable to the network device.

Although the invention has been described with respect to certain specific embodiments, it should be recognized that the invention comprises the claims and their equivalents supported by this disclosure and insubstantial variations thereof.

What is claimed is:

1. A bidirectional coupling for data transmission between two frame-based network devices, the coupling comprising:

a cable; and a first cable connector coupled to a first end of the cable and a second cable connector coupled to a second end of the cable, the cable connectors each configured for coupling to a network device;

wherein the cable includes wires, the wires including at least two differential pairs of wires, each differential pair of wires comprising at least two wires, wires in a first one of the differential pairs providing a transmission path between the network devices and wires in a second one of the differential pairs providing a reverse transmission path between the network devices;

wherein each of the cable connectors includes a plurality of conductive pins each electrically coupled to a corresponding wire of the wires, the pins being arranged along a first row and a second row, the second row parallel to the first row; and wherein at least two wires in each of the differential pairs are coupled to two adjacent pins along one of the first row or the second row.

2. The bidirectional coupling of claim 1, wherein at least two wires in at least one of the differential pairs are bundled with a shield wire to form a shielded pair.

3. The bidirectional coupling of claim 1 wherein each cable connector comprises:

a housing having a floor, a ceiling, a pair of side walls and a rear wall, the floor and the ceiling being coupled together at opposing side margins by the pair of side walls, the rear wall having an aperture; and the conductive pins located substantially within the housing, the conductive pins having forward ends and rear ends, the rear ends electrically connected to the wires within the cable.

4. The bidirectional coupling of claim 3, wherein the aperture is bounded by a cylindrical guide configured to receive a cable that is substantially circular in cross-section.

5. The bidirectional coupling of claim 3, wherein the conductive pins are located entirely within the housing.

6. The bidirectional coupling of claim 3, wherein a first row includes more pins than a second row;

wherein the pins in each row are offset from the pins in the other row; and wherein the forward ends of the pins are configured for sandwiching a plate or a substrate.

7. The bidirectional coupling of claim 3, wherein a forward end of a one of the pins is recessed as compared to forward ends of other pins.

8. The bidirectional coupling of claim 6, wherein the cable includes four shielded pairs; and wherein each of the cable connectors includes nineteen conductive pins.

9. The bidirectional coupling of claim 6, wherein the cable includes eight shielded pairs; and wherein each of the cable connectors includes twenty nine conductive pins.

10. The bidirectional coupling of claim 2, wherein for each of the cable connectors the pins of the first row are staggered with respect to the pins of the second row; and wherein the shield wire in each of the shielded pairs is coupled to a pin of the first row or to a pin of the second row and the two wires in the differential pair are coupled to two adjacent pins of the second row or to two adjacent pins of the first row, with the pin coupled to the shield wire staggered between the two adjacent pins.

11. The bidirectional coupling of claim 10, wherein each of the wires in each of the shielded pairs is connected to corresponding pins of the two cable connectors housing the same relative position within the cable connector.

12. The bidirectional coupling of claim 1 wherein the cable includes a first shielded pair, a second shielded pair, a third shielded pair, and a fourth shielded pair, each of the shielded pairs having a first end coupled to the pins of the first cable connector and a second end coupled to the pins of the second cable connector;

wherein the first end of the first shielded pair is coupled to the first cable connector at pins of a first group, wherein the first end of the second shielded pair is coupled to the first cable connector at pins of a second group;

wherein the first end of the third shielded pair is coupled to the first cable connector at pins of a third group;

wherein the first end of the fourth shielded pair is coupled to the first cable connector at pins of a fourth group;

wherein each of the wires in at least two of the shielded pairs is connected to corresponding pins of the two cable connectors having different relative positions within the cable connector, whereby the at least two of the shielded pairs are cross-connected.

13. The bidirectional coupling of claim 12, wherein the first shielded pair and the third shielded pair are cross-connected; and wherein the second shielded pair and the fourth shielded pair are cross-connected.

14. The bidirectional coupling of claim 12, wherein the first shielded pair and the second shielded pair are cross-connected; and wherein the third shielded pair and the fourth shielded pair are cross-connected.

15. The bidirectional coupling of claim 12, wherein the first shielded pair and the fourth shielded pair are cross-connected; and wherein the second shielded pair and the third shielded pair are cross-connected.

16. A method for bidirectional data transmission between two frame-based network devices coupled together by a cable having a plurality of wires including differential pairs of wires, each of the differential pairs being bundled with a third wire for shielding thereby forming a shielded pair, the wires being coupled to each of the network devices through a cable connector, the cable connector including pins coupled to the wires, the method comprising:

transmitting data in a first direction over a first set of shielded pairs coupled to a first cable connector at a first group of pins, the pins in the first group being adjacent one another; and transmitting data in a second direction reverse to the first direction over a second set of shielded pairs coupled to the first cable connector at a second group of pins, the pins in the second group being adjacent one another;

wherein the wires in each shielded pair are coupled to adjacent pins at each of the cable connectors.

17. The method of claim 16, further comprising:

handshaking between the two network devices to determine a direction of data transmission over each of the shielded pairs;

wherein either the shielded pair or a fourth wire is utilized for the handshaking.

18. The method of claim 16, further comprising, before the transmitting of data in the first direction:

inverse multiplexing the data at a first one of the network devices; and placing inverse-multiplexed data on the first set of shielded pairs.

19. A bidirectional coupling between a pair of network devices comprising:

a plurality of shielded pairs of wires, the wires each having distal portions connected to a corresponding conductive mating element of a connector, the conductive mating elements selected from a plurality of conductive mating elements arranged in substantially parallel rows, each shielded pair of wires providing a data path between a first network device and a second network device, and at least two of the shielded pairs providing data paths in opposing directions.

20. A bidirectional data path between network devices comprising:

a first connector with a plurality of conductive mating elements arranged in two rows;

a second connector with a plurality of corresponding conductive mating elements arranged in two rows; and a plurality of shielded pairs of wires connecting the first connector and the second connector, each wire of the shielded pairs of wires connecting non-corresponding conductive mating elements of the first connector and the second connector.

21. A network device configured for bidirectional communication with a second network device through a cable, the network device comprising:

a device connector for mating with an external cable connector and receiving input from and providing output to the cable connector, the external cable connector comprising a housing having a floor, a ceiling, a pair of side walls and a rear wall, the floor and the ceiling being coupled together at opposing side margins by the pair of side walls, the rear wall having an aperture and conductive pins located substantially within the housing, the conductive pins having forward ends and rear ends, the rear ends electrically connected to wires within the cable, the forward ends being arranged in two parallel rows;

an input processing block for processing the input received at the cable connector;

an output processing block for processing the output to the cable connector;

a switch engine coupled to the input processing block and the output processing block, the switch engine having at least one cross-switch and providing a switching function; and a controller for controlling the switch engine;

wherein the input processing block and the output processing block perform data recovery, serialization/deserialization, signal equalization, and queuing.

22. An apparatus comprising:

a first network device;

a second network device;

a cable; and a first cable connector coupling a first end of the cable and the first network device and a second cable connector coupling a second end of the cable and the second network device;

wherein the cable includes wires, the wires including at least two differential pairs of wires, each differential pair of wires comprising at least two wires, wires in a first one of the differential pairs providing a transmission path between the network devices and wires in a second one of the differential pairs providing a reverse transmission path between the network devices;

wherein each of the cable connectors includes a plurality of conductive pins each electrically coupled to a corresponding wire of the wires, the pins being arranged along a first row and a second row, the second row parallel to the first row; and wherein at least two wires in each of the differential pairs are coupled to two adjacent pins along one of the first row or the second row.

23. The apparatus of claim 22 wherein the network devices are Ethernet switches.

24. The apparatus of claim 23 wherein the first Ethernet switch is configured to transmit an Ethernet frame to the second Ethernet switch over the cable, with the Ethernet frame encapsulated in a data transmission encoding format.

25. The apparatus of claim 23 wherein the second Ethernet switch is configured to transmit an Ethernet frame to the first Ethernet switch over the cable, with the Ethernet frame encapsulated in a date transmission encoding format.

* * * * *